US007066685B2

(12) United States Patent
Humphries et al.

(10) Patent No.: US 7,066,685 B2
(45) Date of Patent: Jun. 27, 2006

(54) DRAINAGE GRATE

(75) Inventors: Derek Humphries, Chardon, OH (US); Roy Humpage, West Midlands (GB); Gary Edwin Mayo, Staffordshire (GB)

(73) Assignee: ACO Polymer Products, Inc., Chardon, OH (US)

( * ) Notice: Subject to any disclaimer, the term of this patent is extended or adjusted under 35 U.S.C. 154(b) by 0 days.

(21) Appl. No.: 10/823,928

(22) Filed: Apr. 14, 2004

(65) Prior Publication Data

US 2005/0232701 A1 Oct. 20, 2005

(51) Int. Cl.
*E03F 5/06* (2006.01)

(52) U.S. Cl. ..... 405/43; 210/164; 210/163

(58) Field of Classification Search ..... 405/36, 405/39, 40, 43; 210/163, 164
See application file for complete search history.

(56) References Cited

U.S. PATENT DOCUMENTS

| | | | | |
|---|---|---|---|---|
| 2,305,955 | A | 12/1942 | Dudley | 210/164 |
| 3,859,000 | A | 1/1975 | Webster | 404/41 |
| 4,013,021 | A | 3/1977 | Steinlein et al. | 108/57.25 |
| 4,367,142 | A | 1/1983 | Blecher | 210/163 |
| 4,553,874 | A | 11/1985 | Thomann et al. | 404/4 |
| RE32,248 | E | 9/1986 | Blecher | 210/163 |
| 5,529,436 | A | 6/1996 | Meyers | 405/119 |
| 5,989,417 | A | 11/1999 | Fleischhacker | 210/163 |
| 6,143,168 | A | 11/2000 | Shackelford | 210/164 |
| 6,418,861 | B1 | 7/2002 | Flam | 108/56.1 |
| 6,767,456 | B1 * | 7/2004 | Middleton et al. | 210/156 |

* cited by examiner

*Primary Examiner*—David Bagnell
*Assistant Examiner*—Tara L. Mayo
(74) *Attorney, Agent, or Firm*—Pearne & Gordon LLP

(57) ABSTRACT

A drainage grate assembly having a drainage grate which is reinforced by a substantially continuous reinforcing member confined within the grate. The load rating for the drainage grate assembly can be adjusted by adding metal strips which can be disposed within and retained by the reinforcing member.

25 Claims, 4 Drawing Sheets

DRAINAGE GRATE

BACKGROUND OF THE INVENTION

The present invention relates to drainage grates used in connection with trench drains and the like for the drainage of surface water. Trench drains and similar drainage structures are used in a variety of environments, such as walkways, bike and foot paths, outdoor malls, parking lots, airport tarmacs and other traffic environments which require the drainage of surface water. Trench drains and drainage structures generally are known in the art as described in, for example, U.S. Pat. Nos. 4,630,966; 4,699,544; 5,462,382 and 4,553,874, incorporated herein by reference. In order to provide access of surface water to the drainage structure, while at the same time enabling practical movement of traffic across the structure, apertured drainage grates are typically employed to provide a substantially continuous surface over which pedestrian or vehicle traffic can freely move.

Drainage grates are typically made of varying gauges of sheet metal and are, therefore, subject to damage. Dents, buckles and perforations in the drainage grate are not only aesthetically undesirable, but are also safety concerns which can lead to injury to pedestrians and damage to surface vehicles. Accordingly, drainage grates must meet particular load ratings depending upon the environment in which they are to be used. Although there is no universal system for load rating of trench drains, the internationally recognized DIN 19580 standard, incorporated herein by reference, provides a good basis on which to distinguish between classes. Basically, for trench drains under 8 inches wide, a class A rating will withstand 15 psi within the standard 3 inch by 10 inch load footprint, and is typically used in residential and light pedestrian areas. A class B rating will withstand 140 psi in the load footprint, and is typically used for sidewalks and small private parking lots. A class C rating will withstand 280 psi in the load footprint and is appropriate for commercial parking lots and the like. Classes D and above will withstand 450 psi or more in the load footprint and are found in roads or other areas experiencing heavy wheel loads.

The requirement for different load ratings typically means that a manufacturer must provide different grates for different applications. Thus, in practicality, a manufacturer must provide grates of different gauges and materials or which include various reinforcements appended thereto. However, there are practical limits to the gauges of metal which can be used and, even when various reinforcements are included, they do not provide continuous support to the entire drainage grate surface. Thus, even a reinforced grate is still subject to damage in those regions which are not directly reinforced.

In view of the foregoing shortcomings, the present invention advantageously provides a reinforced drainage grate which provides continuous support to all or most of the drainage grate surface, and which can provide a wide range of load ratings without having to manufacture and inventory different grates for each desired load rating.

SUMMARY OF THE INVENTION

In accordance with the invention there is provided an improved drainage grate assembly which provides improved reinforcement and enables the use of varying gauges of sheet metal where other, more durable and costly materials such as cast iron might otherwise be required. Moreover, the instant invention is advantageously capable of providing substantially continuous support and reinforcement to the entire drainage grate. Accordingly, in one embodiment of the invention there is provided a reinforced drainage grate assembly comprising an elongate drainage grate and a reinforcing member disposed within the drainage grate. The drainage grate has a substantially planar drainage surface including a plurality of apertures there through and a pair of longitudinally extending side portions, each side portion extending orthogonally below the drainage surface and including a bottom flange extending toward the opposing one of said side portions. The reinforcing member is disposed between the bottom flanges and the underside of the drainage surface so that the upper surface of the reinforcing member abuts the underside of the drainage surface.

In one aspect of the invention, the reinforcing member has longitudinal side portions adjacent the side portions of the drainage grate and includes a plurality of apertures there through, wherein at least a portion of the apertures are co-registered with at least a portion of the apertures in the drainage surface so as to permit the passage of fluids from the drainage surface through the reinforcing member, and wherein the upper surface of the reinforcing member includes at least one continuous upper surface portion disposed inwardly of the portions of the member disposed between the lower flanges and drainage surface and extending longitudinally from one end of the reinforcing member to the other. In one embodiment, a plurality of the apertures in the reinforcing member are of substantially the same dimensions as, and co-registered with, a corresponding plurality of apertures in the drainage surface. In another embodiment, the area of the upper surface of the reinforcing member is greater than the area of the apertures in the reinforcing member. In yet another embodiment, the reinforcing member includes a plurality of apertures disposed orthogonally between the side portions of said drainage grate. Preferably, the apertures are disposed in a line or an array of lines substantially perpendicularly between the side portions of said drainage grate.

It is another aspect of the invention to provide a reinforcing member which further comprises a plurality of slots disposed therein, the slots being adapted to receive one or more metal strip therein. Preferably, the slots extend substantially perpendicular to the pair of side portions and are adapted to receive one or more metal strips therein. In this manner there is provided an adjustable load rating drainage grate assembly comprising the aforementioned drainage grate and reinforcing member, where the plurality of slots are disposed within the reinforcing member in a manner adapted to alter the load rating of the drainage grate depending upon the number and/or gauge of metal strips which are disposed within said slots.

In one embodiment, the reinforcing member does not include any metal strips and the drainage grate has a Class A rating. In another embodiment, the reinforcing member will include a plurality of metal strips disposed in a suitable number of slots in a manner adapted to provide the drainage grate with a Class B rating. In yet another embodiment of the invention, the reinforcing member will include a plurality of metal strips disposed in a suitable number of slots in a manner adapted to provide the drainage grate with a Class C rating. In a preferred embodiment, the drainage grate and reinforcing member are substantially rectangular.

In yet another aspect of the invention, the reinforcing member includes at least one elongate fastening member extending orthogonally from its bottom surface which includes an enlarged distal end portion adapted to cooperate with a receiving aperture in a drainage channel. In the preferred embodiments, the reinforcing member is formed of a single piece of plastic. More preferably still, the aforementioned fastening member is affixed directly to the bottom of the reinforcing member or molded integrally thereto.

A greater understanding of these and other aspects of the invention will be had from the following detailed description and accompanying drawings.

DETAILED DESCRIPTION OF THE PREFERRED EMBODIMENTS

Figures 1, 2:
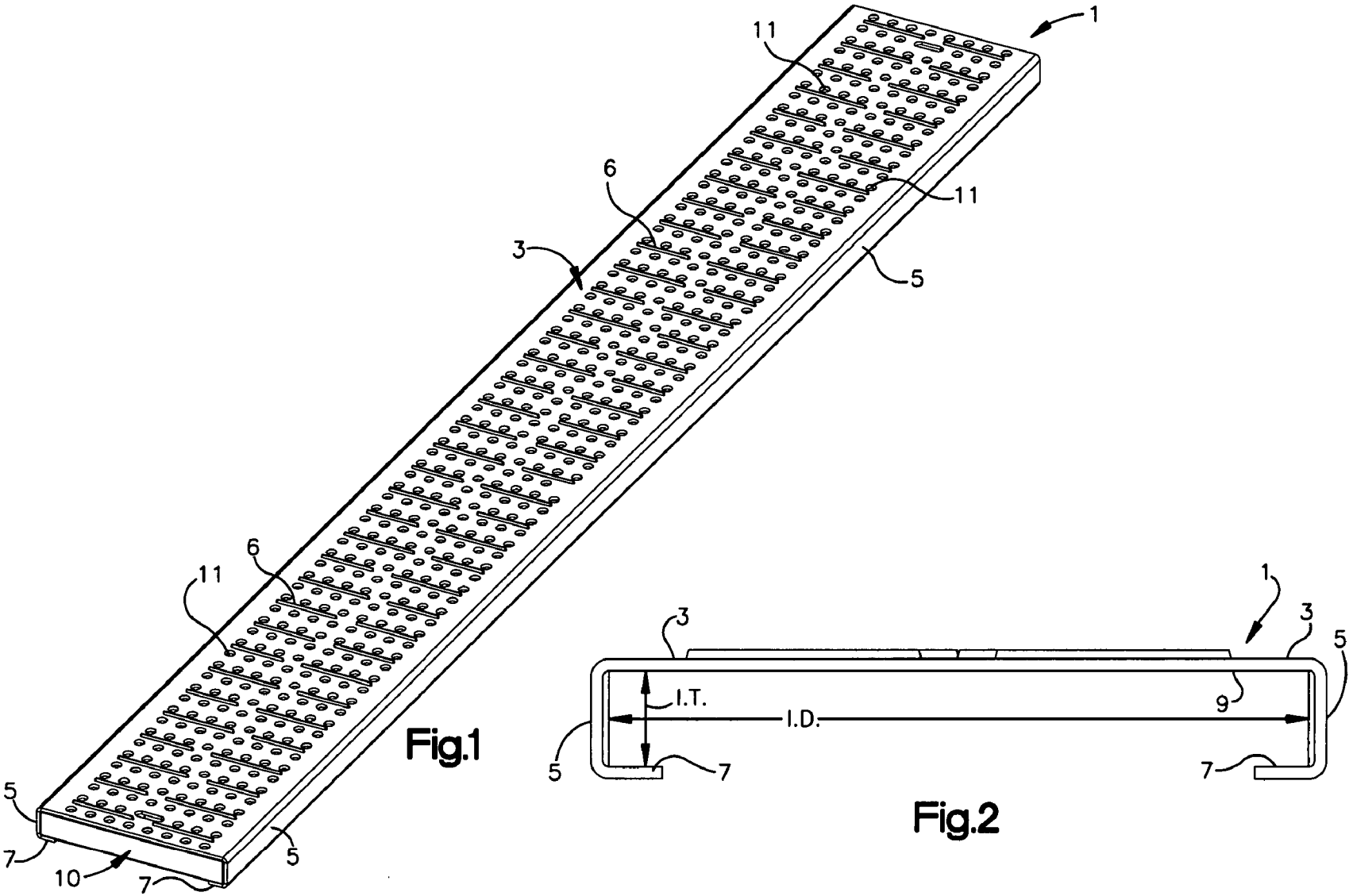
FIG. 1 is a elevational perspective view of a drainage grate assembly according to the invention.
FIG. 2 is a cross-section of a drainage grate suitable for use in a drainage grate assembly according to the invention.
Figure 4A:
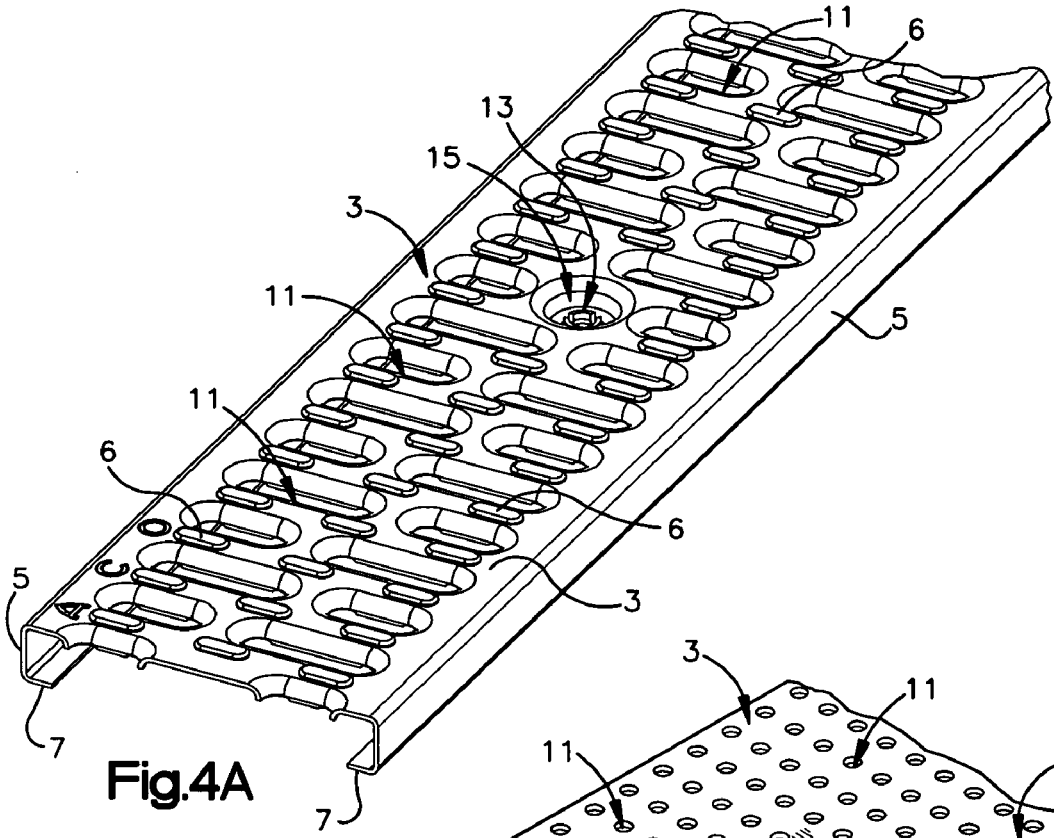
FIGS. 4A–4C are perspective views of various drainage grates and aperture patterns suitable for use in a drainage grate assembly according to the invention.

As seen with reference to the drawings, the preferred drainage grate assembly of the invention comprises an outer drainage grate, shown generally at 1, and an inner reinforcing member, shown generally at 10. As seen most clearly with reference to FIGS. 1 and 2, the drainage grate 1 is formed of sheet metal having a generally planar upper drainage surface 3, and a pair of opposed side portions 5 extending orthogonally below the drainage surface 3. In each case the side portions 5 include a lower flange portion 7 extending orthogonally, preferably perpendicularly, from the side portion toward the other of said side portions 5. As shown, the flange portions 7 extend continuously along the length of said side portions 5. However, as would be apparent to those of ordinary skill in the art in view of the instant disclosure, the flange portions 7 can be discontinuous, whereby a series of flange portions 7 can be disposed along the length of side portions 5, so long as they provide support for and act to retain the reinforcing member 10 between said flange portions 7 and the lower surface 9 of said drainage grate. As seen in FIGS. 1 and 4A, and as would be apparent to those of ordinary skill in the art, the upper surface of drainage grates according to the invention can optionally include raised ribs or nobs 6 where improved traction is desired.

Typical metal gauges suitable for use in the manufacture of drainage grates according to the invention will be on the order of 2 millimeters or less. The particular type of sheet metal used will depend upon application and aesthetic requirements, although sheet steel is generally preferred. The particular gauge used will depend upon various factors including cost and grate width, with wider grates generally requiring thicker gauges. Of course, the reinforcing member of the present invention advantageously enables the use of thinner and hence less costly gauges. Selection of suitable materials will be within the level of ordinary skill in the art in view of the instant disclosure. Likewise, the stamping, rolling and bending processes used to fashion the drainage grates according to the invention are also well within the skill in the art. Accordingly, as will be apparent to those of ordinary skill in the art reading the instant disclosure, any standard metal shaping technique known in the art will be suitable for making and shaping the drainage grates according to the instant invention.

In a preferred embodiment, the drainage grate 1 is formed and shaped separately from the reinforcing member 10, such that the reinforcing member 10 is thereafter inserted longitudinally into the drainage grate 1 and secured in place. Alternatively, the drainage grate 1 can be formed and then shaped around reinforcing member 10, whereafter the reinforcing member 10 is secured in place within the drainage grate 1. The reinforcing member can be secured within the drainage grate by any means which does not interfere with its ability to properly seat within a drainage channel. Suitable means can include mechanical fasteners or the provision of additional flange portions at opposite ends of the grate 1 which can be bent over the opposed ends of the reinforcing member 10. In the preferred embodiment, the reinforcing member 10 includes one or more detents 8, in its periphery adjacent the flange portions 7, whereby the reinforcing member is secured within drainage grate 1 by a simple crimping or stamping action on the portion of the flanges 7 adjacent the detents 8.

Figure 4B:
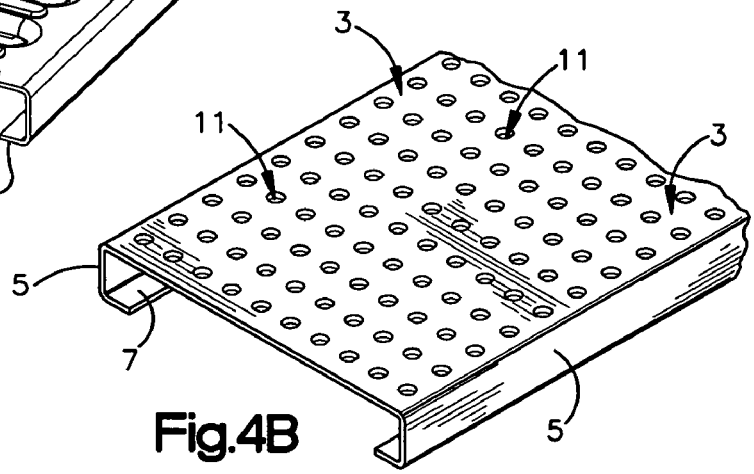
Figure 4C:
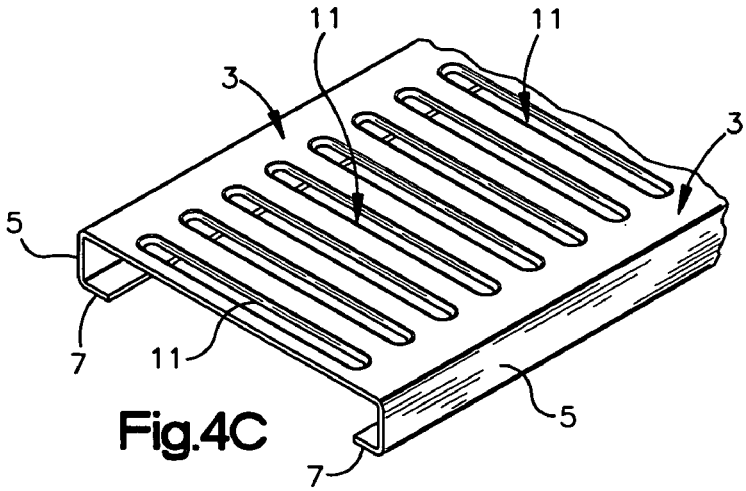

As seen in FIG. 1, the drainage surface 3 of drainage grate 1 includes a plurality of apertures 11 for the passage of fluids from the surface of the drainage grate to the drainage structure, such as a trench drain [not shown]. The particular size, shape and pattern of apertures 11 is largely a matter of choice, so long as they function within the intended use environment to permit passage of fluids from the surface of the drainage grate. For example, in use environments where pedestrian traffic is not anticipated, but water removal requirements are high, then larger and more numerous apertures are needed. By contrast, in use environments where pedestrian traffic is high, smaller apertures are necessary in order to avoid potential injury associated with high heels and the like. Some preferred patterns according to the invention are shown in FIGS. 4A–4C. Selection of any particular aperture design for any particular use environment within the scope of the instant invention will be within the level of skill in the art in view of the instant disclosure.

Figure 3A:
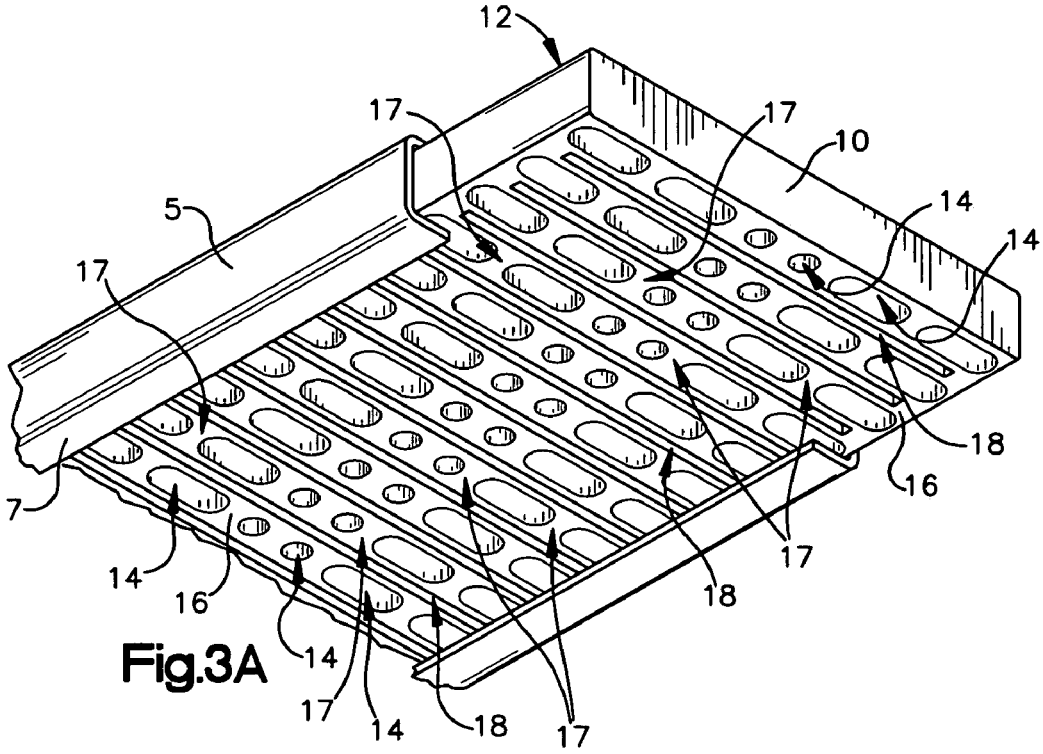
FIGS. 3A and 3B are perspective views of the undersides and reinforcing members of drainage grate assemblies according to the invention.
Figure 3B:
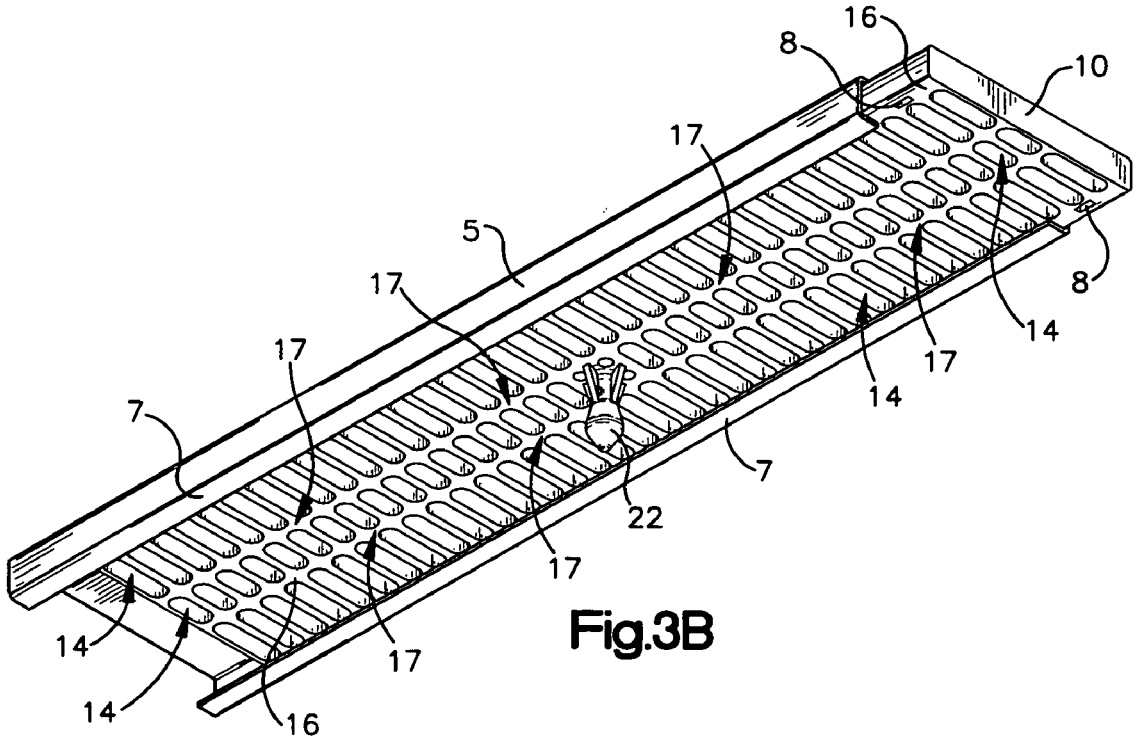

As seen best in FIGS. 3A and 3B, the drainage grate assembly of the invention further includes a reinforcing member 10. As shown, reinforcing member 10 is an essentially rectangular piece of solid material dimensioned to fit within the inner dimension (I.D.) and inner thickness (I.T.) (FIG. 2) of the drainage grate 1. When disposed within the grate 1, the upper surface 12 of the reinforcing member 10 abuts against the bottom surface 9 of the drainage grate 1 and is retained there by the abutment of the bottom surface 16 of the reinforcing member against the inner surfaces of the flange portions 7. The reinforcing member 10 is preferably made of plastic. Suitable plastics for using in the invention will be apparent to those of ordinary skill in the art in view of the instant disclosure. Preferably, the plastic is polyvinyl chloride (PVC), high density polyethylene (HDPE) or polypropylene. The member 10 can be molded or extruded and machined using well known plastic manufacturing techniques within the level of skill in the art in view of the instant disclosure. The reinforcing member 10 is preferably injection molded.

As best seen in FIGS. 3A and 3B, the reinforcing member 10 includes a plurality of apertures 14 which extend from the upper surface 12 to the lower surface 16 so as to permit the passage of fluids through the reinforcing member. In the embodiments shown, the apertures extend through the reinforcing member such that the pattern of the lower surface 16 matches the pattern of the upper surface 12. As with the drainage grate 1, the size, shape and pattern of apertures in the reinforcing member 10 is largely a matter of choice, so long as a portion of the apertures 14 are co-registered with a portion of the apertures 11 in the drainage grate so as to permit the passage of fluids from the upper surface 3 through the grate 1 and reinforcing member 10. It is not necessary that the apertures 14 be of the same size and dimensions as the apertures 11, or that every aperture 14 correspond to and be co-registered with a corresponding individual aperture 11 in the surface of the drainage grate. For example, a single aperture 14 may correspond to, and be co-registered with a plurality of apertures 11. Conversely, a plurality of apertures 14 may correspond to, and be co-registered with a single aperture 11.

Consistent with the object of the invention to provide substantially continuous support for the drainage surface 3, selection of any particular combination and correspondence of apertures 14 in the reinforcing member with apertures 11 in the drainage grate will be apparent to those of ordinary skill in the art in view of the instant disclosure. Some preferred aperture configurations for the reinforcing member according to the invention are seen in FIGS. 3A and 3B. As shown, the upper and lower surfaces of the reinforcing member include substantially continuous longitudinal portions 17 disposed inwardly of the side portions of the drainage grate. The configuration of FIG. 3A includes four such continuous longitudinal surface portions 17, while the configuration of FIG. 3B employs a pair of continuous longitudinal surface portions 17. These structures impart one of the significant advantages of the preferred embodiments of the invention by providing substantially continuous support to the drainage surface 3, including its longitudinal center region.

Figure 5:
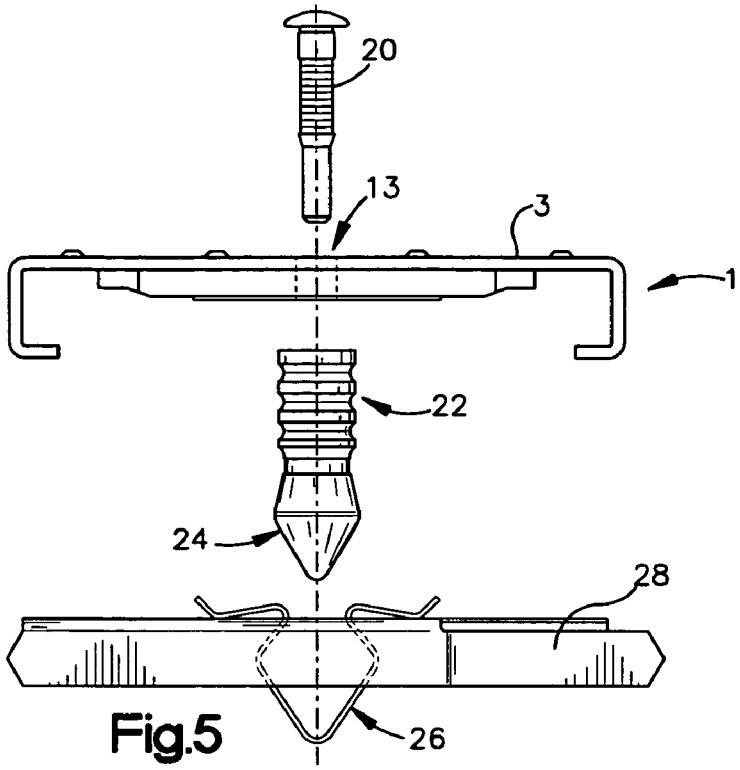
FIG. 5 is an exploded view of a fastening mechanism suitable for use in connection with a drainage grate assembly according to the invention.
Figure 6:
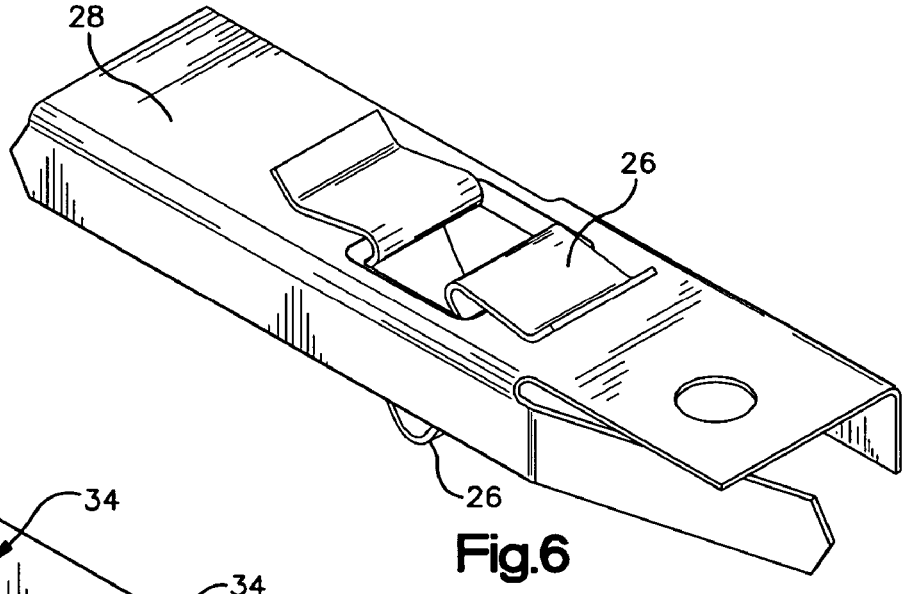
FIG. 6 is an elevational perspective view of a portion of a fastening mechanism suitable for use in connection with a drainage grate assembly according to the invention.

In embodiments of the invention wherein a thru-bolt is used to secure the drainage grate assembly, reinforcing member 10 will include a further aperture which must correspond to and be co-registered with a corresponding thru-bolt aperture 13 (FIG. 4A) of the drainage grate 1. More specifically, in one embodiment, drainage grate 1 further includes one or more apertures 13 for accommodating a thru-bolt or the like for securing the drainage grate to a trench drain or other drainage channel. Typically, the trench drain will include periodic cross members secured therein and spanning the width of the drainage channel. In such arrangements, the cross member includes a threaded aperture for receiving the through bolt so that when the bolt is fastened, the drainage grate is secured to the trench drain channel. Other fastening arrangements are also known in the art and suitable for use in accordance with the drainage grate assembly of the invention. A preferred means of securing the drainage grate assembly of the invention to the trench drain channel is described in European Patent No. 0605792. Briefly, as seen in connection with FIGS. 5 and 6, the drainage grate 1 includes at least one aperture 13 for receiving a through pin 20 rather than a through bolt. Associated with the through pin is a fastening member 22 having an enlarged end 24 for cooperating with a correspondingly shaped clamping spring 26 disposed in a cross bar 28. When the cross bar member 28 is secured within a trench drain channel so as to span the trench drain channel, the assembled drainage grate 1 can be simply snap-fit into the drainage channel by insertion of the fastening member 22 into the clamping spring 26. After elastic deformation of clamping spring 26, the fastening member 22 is secured therein, thereby securing the drainage grate 1 to the trench drain or other drainage channel.

A disadvantage of having to employ either a through bolt or a through pin is the need for the additional through bolt or through pin aperture 13 and the need to form a recess 15 (FIG. 4A) around the aperture to accommodate the head of the bolt or pin so that it sits generally flush with the remaining surface of the grate 1. In a preferred embodiment of the instant invention the reinforcing member can include a fastening member 22 either adhered to the bottom surface 16, e.g., by adhesive, sonic welding, heat welding or the like or, more preferably, molded directly into the bottom surface 16. This enables the advantages of the snap-on connection described above in connection with FIGS. 5 and 6, without the need for apertures 13 and associated recess 15, thereby providing a safe and aesthetically desirable drainage surface.

Figure 7:
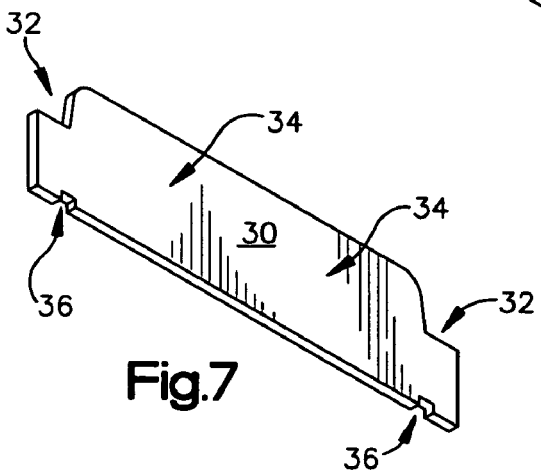
FIG. 7 is a perspective view of a metal reinforcing strip for use in a drainage grate assembly according to the invention.

As seen in FIG. 3A, in one embodiment of the invention, the bottom surface 16 also includes a plurality of slots 18 interposed between apertures 14. The slots 18 are dimensioned so as to receive one or more metal reinforcing strips 30 (FIG. 7). The metal reinforcing strips can be of any suitable dimension so long as they fit within slots 18 and are capable of spanning the inner dimension (FIG. 2) of the drainage grate, whereby they are retained within the reinforcing member 10 by flange portions 7. A preferred metal strip according to the invention, shown generally at 30 in FIG. 7, is configured so as to have shoulder portions 32 which are adapted to rest adjacent flange portions 7, and a thicker body portion 34 for providing additional support to the middle portion of the drainage surface. In the embodiment shown in FIG. 7, at least some of the metal slots further include notches 36. When the reinforcing member includes securing detents 8 (FIG. 3B), the notches 36 prevent those reinforcing strips 30 adjacent the detents 8 from interfering with the crimping or stamping of the flange portions into the adjacent detents.

As will be apparent to those of ordinary skill in the art, depending upon the number and/or gauge of the metal strips present in slots 18, the reinforcing strength of reinforcing member 10, and hence the load rating of the drainage grate 1 will vary. As a general rule, the thicker the gauge and/or the larger the number of metal strips, the higher the load rating will be. Typical gauges for strips used in accordance with the invention will generally be two millimeters or less. Where it is desired to stock thinner gauge strips, multiple strips can be disposed side-by-side within a single slot 18 to achieve the desired effect. In carrying out the invention, one can theoretically obtain load ratings ranging from Class A to Class D or E using the reinforcing member 10 of the invention, although other means of reinforcement and or different materials will generally be used to obtain ratings above Class C. However, as load ratings and test methods may vary throughout the world, those of ordinary skill in the art will recognize that the invention does not lie in the ability to achieve any particular standard or specific test specification. Rather, the invention lies in the provision of a reinforcing member which provides a means by which one of ordinary skill in the art can tailor the support provided to any particular drainage grate to any desired load requirements and obtain substantially continuous support.

In the preferred embodiments according to the invention, the assembly of the drainage grate 1 and reinforcing member 10 will provide a Class A load rating in the absence of any metal strips. Desired load ratings of Class B and Class C can readily be achieved by simply adding metal strips 30 to slots 18 and/or increasing the gauge of the metal strips being employed. In carrying out this aspect of the invention, one can readily approximate the number and/or gauge of metal strips required to obtain the necessary load rating by calculating the I-value for a simply supported beam as is known to those of ordinary skill in the art. However, in practicality, altering the load rating of any particular drainage grate assembly according to the invention is determined empirically by introducing the desired number of metal strips and testing the load rating using a suitable load footprint. This is particularly important because, as noted above, the invention is not limited to the ability to meet any particular rating, test or standard, but can instead be tailored to the needs of any particular situation. In the preferred embodiment, the load rating is empirically tested using a 3 inch by 10 inch load footprint according to DIN 19580, although other suitable methods will be apparent to those of ordinary skill in the art in view of the instant disclosure.

Modifications and variations of the invention will be apparent to those skilled in the art in the light of the foregoing detailed disclosure and drawings. Therefore, it is to be understood that, with the scope of the appended claims, the invention can be practiced otherwise than shown and described.

What is claimed is:

1. A reinforced drainage grate assembly comprising:

(a) an elongate drainage grate having a substantially planar drainage surface including a plurality of apertures there through and a pair of longitudinally extending side portions, each side portion extending orthogonally below said drainage surface and including a bottom flange extending toward the opposing one of said side portions, wherein an inner dimension is defined between said pair of side portions;

(b) a reinforcing member disposed between said bottom flanges and an underside of said drainage surface so that an upper surface of said reinforcing member abuts said underside of said drainage surface, said reinforcing member including a plurality of apertures there through, wherein at least a portion of said apertures in said reinforcing member are co-registered with at least a portion of said apertures in said drainage surface so as to permit the passage of fluids from said drainage surface through said reinforcing member, and wherein said upper surface includes at least one substantially continuous longitudinal upper surface portion disposed inwardly of said portions of said grate disposed between said bottom flanges and said underside of said grate and extending longitudinally from a first end of said reinforcing member to a second end of said reinforcing member, wherein said reinforcing member further comprises a plurality of slots disposed therein that are each adapted to receive a metal strip therein such that the metal strip extends along the inner dimension of the drainage grate and is retained with respect to the reinforcing member by the bottom flanges.

2. The assembly of claim 1 wherein a plurality of said apertures of said reinforcing member are of substantially the same dimensions as, and co-registered with, a corresponding plurality of said apertures in said drainage surface.

3. The assembly of claim 1 wherein at least one of said slots includes at least one metal strip disposed therein.

4. The assembly of claim 1 wherein said slots extend substantially perpendicular to said pair of side portions.

5. The assembly of claim 4 wherein at least one of said slots includes at least one metal strip disposed therein.

6. The assembly according to claim 1 wherein said elongate drainage grate is substantially rectangular, having a length and an inner dimension corresponding to the distance between said side portions, and at least said upper surface of said reinforcing member has a length and dimension substantially the same as said length and inner dimension of said elongate drainage grate.

7. The assembly according to claim 6 wherein said reinforcing member is formed of a single piece of plastic.

8. The assembly according to claim 1 wherein said reinforcing member is formed of a single piece of plastic.

9. The assembly according to claim 1 wherein the area of said upper surface of said reinforcing member is greater than the area of said apertures in said reinforcing member.

10. The assembly according to claim 1 wherein said reinforcing member includes a plurality of apertures disposed orthogonally between said side portions of said drainage grate.

11. The assembly according to claim 1 wherein said reinforcing member includes a plurality of apertures disposed in a line substantially perpendicularly between said side portions of said drainage grate.

12. The assembly according to claim 1 wherein said reinforcing member includes at least one elongate fastening member extending orthogonally from a bottom surface thereof, said fastening member including an enlarged distal end portion.

13. An adjustable load rating drainage grate assembly comprising:

(a) an elongate drainage grate having a substantially planar drainage surface including a plurality of apertures there through and a pair of longitudinally extending side portions, each side portion extending orthogonally below said drainage surface and including a bottom flange extending toward the opposing one of said side portions, wherein an inner dimension is defined between said pair of side portions;

(b) a reinforcing member disposed between said bottom flanges and an underside of said drainage surface so that an upper surface of said reinforcing member abuts said underside of said drainage surface; said reinforcing member further including:

a plurality of apertures there through, wherein at least a portion of said apertures in said reinforcing member are co-registered with at least a portion of said apertures in said drainage surface so as to permit the passage of fluids from said drainage surface through said reinforcing member, and a plurality of slots that are each adapted to receive at least one strip of metal therein such that the metal strip extends along the inner dimension of the drainage grate and is retained with respect to the reinforcing member by the bottom flanges, said slots being disposed within said reinforcing member in a manner adapted to alter said load rating of said drainage grate when a plurality of metal strips are disposed within said slots.

14. The assembly of claim 13 wherein said reinforcing member does not include any metal strips and said drainage grate has a Class A rating.

15. The assembly of claim 13 wherein a plurality of said slots include metal strips disposed therein in a manner adapted to provide said drainage grate with a Class B rating.

16. The assembly of claim 13 wherein a plurality of said slots include metal strips disposed therein in a manner adapted to provide said drainage grate with a Class C rating.

17. The assembly of claim 13 wherein a plurality of said apertures of said reinforcing member are of substantially the same dimensions as, and co-registered with, a corresponding plurality of said apertures in said drainage surface.

18. The assembly of claim 13 wherein said slots extend substantially perpendicular to said pair of side portions and adapted to receive a metal strip therein.

19. The assembly according to claim 13 wherein said elongate drainage grate is substantially rectangular, having a length and an inner dimension corresponding to the distance between said side portions, and at least said upper surface of said reinforcing member has a length and dimension substantially the same as said length and inner dimension of said elongate drainage grate.

20. The assembly according to claim 13 wherein said upper surface of said reinforcing member includes at least one substantially continuous longitudinal upper surface portion disposed inwardly of said portions of said member disposed between said bottom flanges and said underside, and extending longitudinally from a first end of said reinforcing member to a second end of said reinforcing member.

21. The assembly according to claim 20 wherein said reinforcing member is formed of a single piece of plastic.

22. The assembly according to claim 13 wherein said reinforcing member is formed of a single piece of plastic.

23. The assembly according to claim 13 wherein said reinforcing member includes at least one elongate fastening member extending orthogonally from a bottom surface thereof, said fastening member including an enlarged distal end portion.

24. A reinforced drainage grate assembly comprising:

(a) an elongate drainage grate having a substantially planar drainage surface including a plurality of apertures there through and a pair of longitudinally extending side portions, each side portion extending orthogonally below said drainage surface and including a bottom flange extending toward the opposing one of said side portions;

(b) a reinforcing member disposed between said bottom flanges and an underside of said drainage surface so that an upper surface of said reinforcing member abuts said underside of said drainage surface, said reinforcing member including a plurality of apertures there through, wherein at least a portion of said apertures in said reinforcing member are co-registered with at least a portion of said apertures in said drainage surface so as to permit the passage of fluids from said drainage surface through said reinforcing member, and wherein said upper surface includes at least one substantially continuous longitudinal upper surface portion disposed inwardly of said portions of said grate disposed between said bottom flanges and said underside of said grate and extending longitudinally from a first end of said reinforcing member to a second end of said reinforcing member, wherein said reinforcing member further comprises a plurality of slots disposed therein, at least one of said slots including at least one metal strip disposed therein.

25. An adjustable load rating drainage grate assembly comprising:

(a) an elongate drainage grate having a substantially planar drainage surface including a plurality of apertures there through and a pair of longitudinally extending side portions, each side portion extending orthogonally below said drainage surface and including a bottom flange extending toward the opposing one of said side portions;

(b) a reinforcing member disposed between said bottom flanges and an underside of said drainage surface so that an upper surface of said reinforcing member abuts said underside of said drainage surface; said reinforcing member further including:

a plurality of apertures there through, wherein at least a portion of said apertures in said reinforcing member are co-registered with at least a portion of said apertures in said drainage surface so as to permit the passage of fluids from said drainage surface through said reinforcing member, and a plurality of slots adapted to receive at least one strip of metal therein, at least one of said slots including at least one metal strip disposed therein, said slots being disposed within said reinforcing member in a manner adapted to alter said load rating of said drainage grate when a plurality of metal strips are disposed within said slots.

* * * * *